United States Patent [19]

Polyak, Jr.

[11] 4,093,022

[45] June 6, 1978

[54] HEAT EXCHANGER

[76] Inventor: George Polyak, Jr., R.D. #1, Box 131B, Mt. Hope, Wharton, N.J. 07885

[21] Appl. No.: 792,780

[22] Filed: May 2, 1977

[51] Int. Cl.[2] ..... F28D 7/00

[52] U.S. Cl. ..... 165/39; 165/DIG. 2; 165/102; 165/157; 165/159

[58] Field of Search ..... 165/DIG. 2, 102, 157, 165/159, 162, 39

[56] References Cited

U.S. PATENT DOCUMENTS

| | | | |
|---|---|---|---|
| 1,226,299 | 5/1917 | Boltz | 165/159 |
| 2,062,321 | 12/1936 | Levin | 165/159 |
| 2,274,494 | 2/1942 | Moser | 165/102 |
| 2,519,084 | 8/1950 | Tull | 165/159 |
| 2,764,391 | 9/1956 | Pullen | 165/DIG. 2 |
| 3,944,136 | 3/1976 | Huie | 165/DIG. 2 |

*Primary Examiner*—Charles J. Myhre
*Assistant Examiner*—Margaret A. LaTulip
*Attorney, Agent, or Firm*—Thomas N. Neiman

[57] ABSTRACT

As shown in an embodiment of the invention as depicted, the heat exchanger comprises a cylindrical chamber into which, and from which heated fluid, such as the combustion gas product from a furnace, is conducted. The chamber confines therewithin a plurality of axially-extending tubes, and ducting admits ambient air to and from the tubes. Accordingly, the heated fluid and the ambient air are indirectly heat-exchanged. The chamber is fixed within an enclosure or housing, except that an axially-extending portion of the chamber is left exposed, in order that the heated-fluid input and discharge can be effected directly to and from the chamber. The housing forms a compartment alongside of the chamber, and to a given side thereof, which compartment causes the ambient air to cycle or pump through the tubes and compartment, prior to any substantial air-discharge, to generate an improved draft or current flow in the heat exchanger.

9 Claims, 5 Drawing Figures

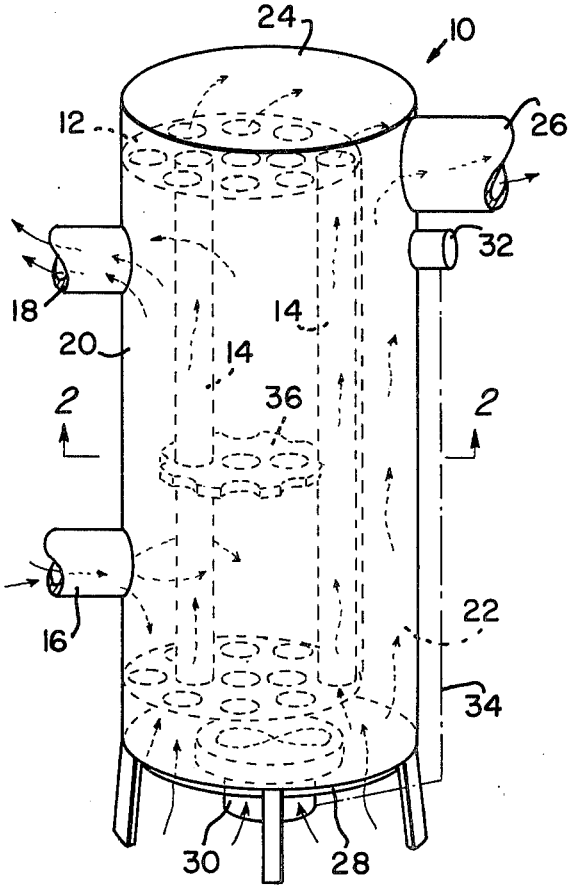
FIG. 1
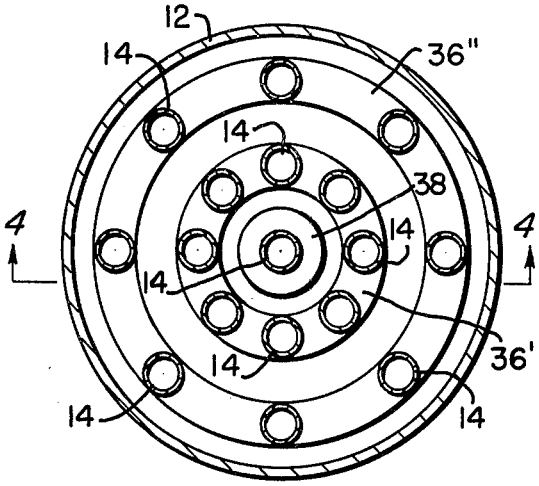
FIG. 3
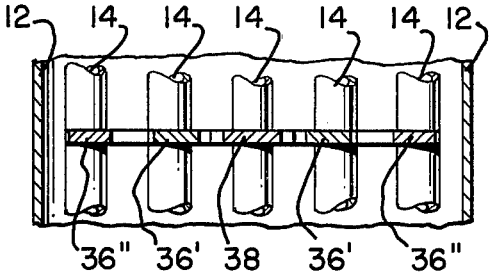
FIG. 4
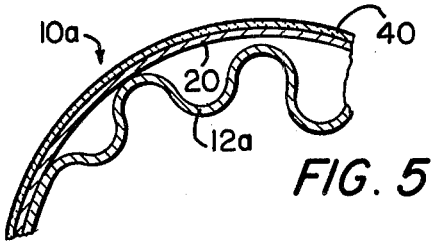
FIG. 5
FIG. 2
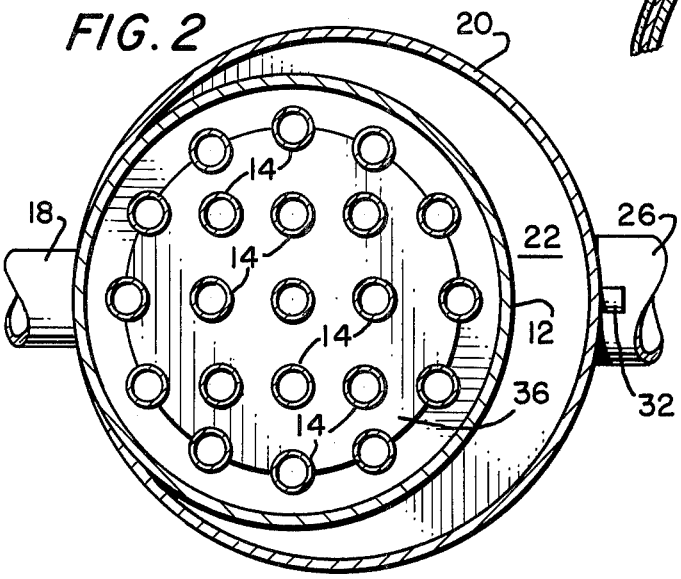

HEAT EXCHANGER

This invention pertains to heat exchangers, and in particular to indirect, fluid to fluid heat exchangers which employ tubed chambers which direct one of the fluids through the tubing and the other fluid in heat-exchanging contact with the tubing.

Heat exchangers of the type just noted are well known, and enjoy a not unreasonable efficiency, especially if either one or both of the fluids are impelled by a motorized air-moving device, such as a blower or suction fan. However, I have determined that these known types of heat exchangers are often limited by "static" operations or functioning in which the fluid (for example, air) which is to be heated is poorly channeled or directed and, as a consequence, its flow, i.e., its current or draft, is ill-defined and lethargic. It is an object of my invention to set forth an improved heat exchanger. Accordingly, it is an object of my invention to disclose a heat exchanger which substantially obviates the "static" or lethargic functioning known in the prior art types. Particularly, it is an object of my invention to set forth a heat exchanger comprising a cylindrical chamber having an elongate axis; said chamber being closed at opposite ends thereof; first means for admitting a heated fluid into said chamber adjacent one end thereof; second means, adjacent an end of said chamber which is opposite said one end, for discharging such fluid from said chamber, conduit means fixed in said chamber and extending axially thereof; said conduit means opening only outwardly of said one and opposite ends of said chamber; third means for admitting ambient air into said conduit means; and fourth means for discharging air from said conduit means; wherein said third and fourth means comprise a housing which substantially envelops said chamber; said housing having a substantially cylindrical wall which terminates in an end wall; said end wall being adjacent to, but spaced apart from, said one end of said chamber; and said wall has a portion thereof which defines a compartment means cooperative with said fluid admitting and discharging means and said air admitting and discharging means to cause ambient air repetitively to cycle or pumpingly circulate through said conduit means and said compartment means.

It is another object of this invention to disclose an improved heat exchanger of the foregoing type which further includes means disposed within said chamber, intermediate said one and opposite ends thereof, for baffling flow of heated fluid therethrough.

Further objects of this invention, as well as the novel features thereof, will become more apparent by reference to the following description, taken in conjunction with the accompanying figures, in which:

FIG. 1 is an illustration, partly cut-away and partly in phantom, comprising an isometric projection of an embodiment of the invention;

FIG. 2 is a view of the embodiment of FIG. 1, taken along section 2—2 of FIG. 1, said cross-sectional view being of about twice the scale of FIG. 1;

FIG. 3 is a cross-sectional view, similar to that of FIG. 2 and of the same scale, taken through or transverse of the tubed chamber of the FIG. 1 embodiment;

FIG. 4 is a fragmentary, cross-sectional view taken along section 4—4 of FIG. 3; and FIG. 5 is a fragmentary cross-sectional view of an alternative embodiment of the invention.

As shown in the depicted embodiment, the novel heat exchanger 10 comprises a cylindrical, axially-extended chamber 12 which has a plurality of axially-disposed tubes 14 fixed therein. For purposes of drawing simplicity, only a few of the tubes 14 are shown; it is to be understood, however, that a good number thereof are comprehended by the embodiment, the same disposed in a broad array. Tubes 14 open only externally of the chamber 12, at opposite axial ends thereof.

A heated-fluid inlet pipe 16 and a heated-fluid outlet pipe 18 are fixed in fluid-flow communication with the interior of the chamber 12 by opening onto an axially-extending side wall of the chamber. Typically, pipe 16 will conduct the gaseous combustion products of a furnance or boiler therethrough, and said products, after having given up heat in the chamber, are conducted through pipe 18 for exhausting thereof to the atmosphere.

A housing 20 of substantially cylindrical configuration envelops a substantial portion of the chamber 12 — excepting the portion of axially-extending side wall of the chamber whereat the pipes 16 and 18 are joined. Housing 20 has a diameter which is greater than that of the chamber 12 and, accordingly, the housing 20 defines an eccentric compartment 22 to one side of the chamber 12. Housing 20 has an end wall 24 spaced apart from, but adjacent to, the heated-fluid discharge end of the chamber 12, and projecting from the housing in adjacency to said end, and in fluid communication with the compartment 22, is an air-discharge duct 26.

In this embodiment of the invention, housing 20 has no wall at the end thereof opposite the wall 24. Rather, this end of the housing 20 is open. A disc type air filter 28 is supported across the open end of the housing (by means not shown). A motorized, air-moving fan 30 is disposed centrally of the open end of the housing 20 (by means not shown) to assist the ingestion of air by the housing 20 and, as explained further on in this specification, to positively move ambient air through the heat exchanger 10.

Prior art heat exchangers known to me either comprise a tubed chamber, not unlike chamber 12, or incorporate an enveloping housing which, however, is concentric with the tubed chamber. Now, as noted priorly, I have found this type of structure to manifest a "static" or lethargic air movement. According to my improved structure, however, a rather dramatic dynamism of air movement or current is exhibited. Exactly why this occurs is not fully understood, however it appears that the eccentric, offset compartment 22 induces a cyclic "pumping" of air vertically upward through the tubes 14, then vertically downward through the compartment 22, initially. Apparently what happens is this: as the heated fluid is admitted into the chamber 12 and discharged via pipe 18, it rises through the chamber 12, giving up heat to air ingested into the housing 20 and passing through the tubes 14. However, with the attrition of heat, as the fluid and air rise vertically, the air is met with a dead and restricted "load" (presented by duct 26). As the air has proceeded to cool slightly, little passes into the duct 26, whereas most thereof descends through the compartment 22 — only to rise again through the tubes 14. Now, however, this re-cycling air moves with an enhanced velocity, in that it was preheated in its first pass. This cycling or pumping proceeds until the uppermost area of the housing 20 commences to collect a mass of air which, due to the level of heating to which it has risen, manifests a sufficient pressure to overcome the "load" of duct 26 and passes thereinto. Therefore, the offset disposition of the compartment 22, and the arrangement of the duct 26 thereat, cooperate with the pre-cycling or pre-heating to establish a strong current flow in the direction of the duct 26.

In order to sense the elevated temperature of the collected air mass at the top of the housing 20, a heat sensor 32 is fixed adjacent to duct 26. By means of electrical linkage 34, the sensor 32 turns on the fan 30 — upon the air mass achieving a predetermined temperature — to cause the fan to move air into housing 20 and tubes 14 with a directed force. Consequently, a greater volume of air is heat-exchanged and, also, any residual air which is descending through compartment 22 is turned and directed toward the duct 26.

The level of heat exchange which will be realized, of course, proceeds from the amount of latent heat in the fluid introduced into the chamber 12 (from the furnace or the like), as well as the volume thereof. In addition, however, the heat exchange will be enhanced if the time of residence of the heated fluid is prolonged. To this end, my invention comprehends the use of a baffle 36, within the chamber 12, intermediate the ends thereof. As shown in FIGS. 1 and 2, baffle 36 is a substantially circular plate in which centrally thereof, and peripherally thereof, are carried the tubes 14. Baffle 36 has an outside diameter which is less than the inside diameter of the chamber 12. Thus, about the baffle 36 there is defined a void to accommodate the conduct of the heated fluid therethrough. The void has an overall area which is at least equal to, or greater than, the cross-sectional, dimensional area of the pipes 16 and 18. Therefore, baffle 36 causes no undue throttling of the heated fluid in its passage through the chamber 12; yet, it enhances the dwell or residency of the fluid in the chamber.

In FIGS. 3 and 4 is shown an alternative embodiment of a baffle usable in chamber 12. In this embodiment, the baffle comprises a plurality of concentric baffle rings 36' and 36'' and a baffle disc 38. Disc 38 is fixed to a central tube 14, and rings 36' and 36'' are fixed to circular arrays of tubes 14. Ring 36'' defines a void between its outside diameter and the inside diameter of the chamber 12; also it defines an annular void with adjacent ring 36'. Ring 36', in turn, defines a fluid-passage accommodating void with adjacent disc 38. Again, the sum of these voids is sufficient to insure an optimum conduct of the heated fluid through the chamber 12, but they insure as well an optimum dwell or residency of the fluid in the chamber to enable a maximum of heat exchange to take place.

While I have described my invention in connection with specific embodiments thereof, it is to be clearly understood that this is done only by way of example and not as a limitation to the scope of my invention as set forth in the objects thereof and in the appended claims. For instance, as shown in FIG. 5, the same comprising a fragmentary depiction of a portion of an alternative embodiment **10*a* of the invention, where the housing 20 has a layer of insulation 40 fixed thereabout — to avoid any undue heat loss to the ambient atmosphere. Also, to enhance the heat exchange, and to increase the effective surface of the tubed chamber, a modified chamber 12*a* is employed. Chamber 12*a* has an undulating periphery, which substantially multiplies its surface — as compared to the surface of chamber 12, the undulations of which commence at one axial side of pipes 16 and 18** and terminate at the axial side opposite.

Other embodiments of the invention and alternative arrangements of the principal components of my novel heat exchanger will occur to others, by taking teaching from my disclosure. All such alternative arrangements and embodiments are deemed to be within the ambit of my invention.

I claim:

1. A heat exchanger, comprising:

a cylindrical chamber having a vertical, elongate axis;

said chamber being closed at opposite axial ends thereof;

first means for admitting a heated fluid into said chamber, in a first direction transverse to said axis, adjacent one end of said chamber;

second means, adjacent an end of said chamber which is opposite said one end, for discharging such fluid from said chamber in a second direction transverse to said axis;

conduit means fixed in and substantially uniformly distributed within said chamber and extending axially thereof;

said conduit means opening only outwardly of said one and opposite ends of said chamber;

third means for admitting ambient air into said conduit means; and fourth means for discharging air from said conduit means; wherein said third and fourth means comprise a housing which substantially envelops said chamber;

said housing having a substantially cylindrical wall which terminates in a closed end wall;

said end wall being adjacent to, but spaced apart from, said one end of said chamber; and said wall has a portion thereof which defines a compartment means cooperative with said fluid admitting and discharging means and said air admitting and discharging means to cause ambient air repetitively to cycle or pumpingly circulate through said conduit means and said compartment means;

said portion of said wall is eccentric relative to said chamber and cooperates with said chamber to define said compartment means of a uniform, crescent-shaped cross-section; and wherein said air discharging means communicates with said compartment means, and comprises means for discharging air from said compartment means in said first direction from a side of said heat exchanger which is opposite said first and second means.

2. A heat exchanger, according to claim 1, wherein:

said air discharging means is in direct fluid-flow communication with said compartment means, and said fluid admitting and discharging means are in direct fluid-flow communication with said chamber.

3. A heat exchanger, according to claim 1, wherein:

said air discharging means comprises a duct; and said duct opens onto said compartment means, adjacent said one end of said chamber, whereat said crescent-shaped cross-section is of greatest width or cross-sectional dimension.

4. A heat exchanger, according to claim 3, further including:

means disposed within said chamber, intermediate said one and opposite ends thereof, for baffling flow of heated fluid therethrough.

5. A heat exchanger, according to claim 4, wherein:

said baffling means comprises a substantially circular plate;

said chamber has a given inside diameter; and said plate has an outside diameter which is less than said given diameter, and is disposed within said chamber normal to the axis of said chamber to define between said chamber and said plate an annular void.

6. A heat exchanger, according to claim 4, wherein:

said baffling means comprises a plurality of concentric rings;

said rings of said plurality having dimensions which dispose each thereof is spaced-apart disposition from another thereof; and each of said rings is disposed normal to the axis of said chamber.

7. A heat exchanger, according to claim 5, wherein:

said fluid admitting means comprises a fluid inlet duct, and a fluid outlet duct;

said ducts are of common cross-section; and said void comprises a cross-sectional area which is not less than said common cross-section, to insure that fluid flow through said chamber will not be unduly throttled.

8. A heat exchanger, according to claim 4, further including:

air-moving, motor means operatively coupled to one of said air admitting and discharging means, for moving air therethrough.

9. A heat exchanger, according to claim 8, further including:

temperature-sensing means operatively coupled to said compartment means and to said motor means for energizing said motor means.

* * * * *